United States Patent [19]

LeBlanc

[11] Patent Number: 4,576,085

[45] Date of Patent: Mar. 18, 1986

[54] SLIP RING ASSEMBLY

[75] Inventor: Richard S. LeBlanc, Mt. Clemens, Mich.

[73] Assignee: General Motors Corporation, Detroit, Mich.

[21] Appl. No.: 654,713

[22] Filed: Sep. 26, 1984

Related U.S. Application Data

[63] Continuation of Ser. No. 437,854, Oct. 29, 1982, abandoned.

[51] Int. Cl.[4] ..... F41H 7/02

[52] U.S. Cl. ..... 89/36.13; 89/41.02; 339/5 M

[58] Field of Search ..... 89/36.13, 41.02; 339/5 P, 258 R, 5 R, 5 M, 6 R, 8 R

[56] References Cited

U.S. PATENT DOCUMENTS

| | | | |
|---|---|---|---|
| 2,725,540 | 11/1955 | Scott | 89/41.02 |
| 3,066,386 | 12/1962 | Filipczak | 339/8 R |
| 3,559,145 | 1/1971 | Spencer | 339/8 R |
| 3,793,606 | 2/1974 | Wilson | 339/8 R |
| 3,953,095 | 4/1976 | Iino et al. | 339/6 R |
| 4,106,830 | 8/1978 | Sorgatz | 339/8 R |
| 4,189,702 | 2/1980 | Maloy | 339/6 R |
| 4,281,328 | 7/1981 | Shores | 339/5 M |
| 4,323,748 | 4/1982 | Likins | 339/8 R |
| 4,335,927 | 6/1982 | Allen et al. | 339/5 R |

FOREIGN PATENT DOCUMENTS

| | | | |
|---|---|---|---|
| 1228689 | 11/1966 | Fed. Rep. of Germany | 339/5 R |
| 3041866 | 6/1982 | Fed. Rep. of Germany | 89/36.13 |
| 2307385 | 11/1976 | France | 339/5 R |
| 7506838 | 6/1975 | Netherlands | 339/5 R |
| 1157234 | 7/1969 | United Kingdom | 89/36.13 |

*Primary Examiner*—Stephen C. Bentley
*Attorney, Agent, or Firm*—Edward J. Biskup

[57] ABSTRACT

The invention disclosed herein relates to an armored vehicle having a rotatable coupola or turret for rotating a weapons system to the target. The turret includes a depending cage for housing personnel which operates the various electrical and manual equipment within the turret. A slip ring assembly having a low profile is provided at the bottom of this turret cage for transmitting electrical, hydraulic and pneumatic power from stationary sources within the vehicle body to the various equipment to be operated within the turret. This system includes a slip ring platter fixed to the vehicle body portion and having a number of concentric grooves for electrical communication with the stationary source.

2 Claims, 3 Drawing Figures

16
8
14
20
19
18
10
12

SLIP RING ASSEMBLY

This is a continuation of co-pending application Ser. No. 437,854 filed on Oct. 29, 1982, now abandoned.

BACKGROUND OF THE INVENTION

The invention generally relates to light armored vehicles having weapons systems located within a turret shell or cupola on the upper portion of the vehicle. The turret shell rotates on bearings to facilitate movement of the weapons systems throughout 360 degrees arc for firing on any target in any position relative to the light armored vehicle. A portion of the turret suspended includes a turret basket suspended within the vehicle and typically having two seats, one for the gunner and one for the commander, to operate the weapons system as well as other vehicle equipment. Mechanisms for rotating the turret, driving the weapons systems to the desired azimuth and elevating or depressing the weapons system to the desired attitude are located within the turret basket. The power source on the other hand for operating these systems is often located within the portion of the vehicle stationary with respect to the turret. Consequently, the delivery of power whether it be electrical, hydraulic or pneumatic must be through a moving coupling mechanism to provide for delivery from a stationary source to rotatable elements of the turret assembly.

Conventional systems for effecting this transfer of power, at least from an electrical source, have included a vertically oriented cylinder extending into the personnel basket or cage but fixed to the vehicle body. The cage, configured to rotate about the cylinder, engages a number of commutators spaced vertically along the cylinder length which completely circumscribe the cylinder for contact by brushes fixed to the turret assembly. These brushes are supported on a carrier which telescopes over the vertical cylinder such that electrical power delivered from a stationary source in the vehicle to the commutators can be transferred to the rotating brushes as the cage rotates about the cylinder. Electrical equipment within the cage is connected through respective brushes to communicate the electrical power source delivered to each of the commutators. Other sources of power such as hydraulic systems and pneumatic systems are delivered through a similar operation of rotative and stationary elements extending well into the cage.

The system described above, it has been found, encompasses a substantial volume within the cage depriving the personnel of needed space and forcing outward placement of other equipment. For example, when an ammunition box is used, it often must be configured and placed within the cage to circumscribe the vertically oriented cylinder carrying the commutators. As a result, the ammunition cannot be stored properly.

The invention described in this application overcomes many of the problems associated with delivering electricity and other power sources from a stationary source within the vehicle through a rotatable mechanism to other elements within the cage. This is accomplished with a substantially lower profile than has been achieved before facilitating the convenient operation and replacement of equipment within the cage. For example, an ammunition box can be utilized which extends linearly through the center of rotation for the cage, thus maximizing the space for other equipment.

The brushes for engaging the electrical source equipment are removable such that easy replacement can be made to accommodate different types of equipment. Similarly, hydraulic and pneumatic equipment can be delivered through the center of the low profile system discussed above without incursion on the savings in space and other efficiencies described above.

The above has been a general description of some features and advantages of applicant's invention in comparison with some deficiencies of what has been done before. Other advantages will be more fully appreciated from the detailed discussion of the preferred embodiment which follows.

DETAILED DESCRIPTION OF THE PREFERRED EMBODIMENT

Figure 1:
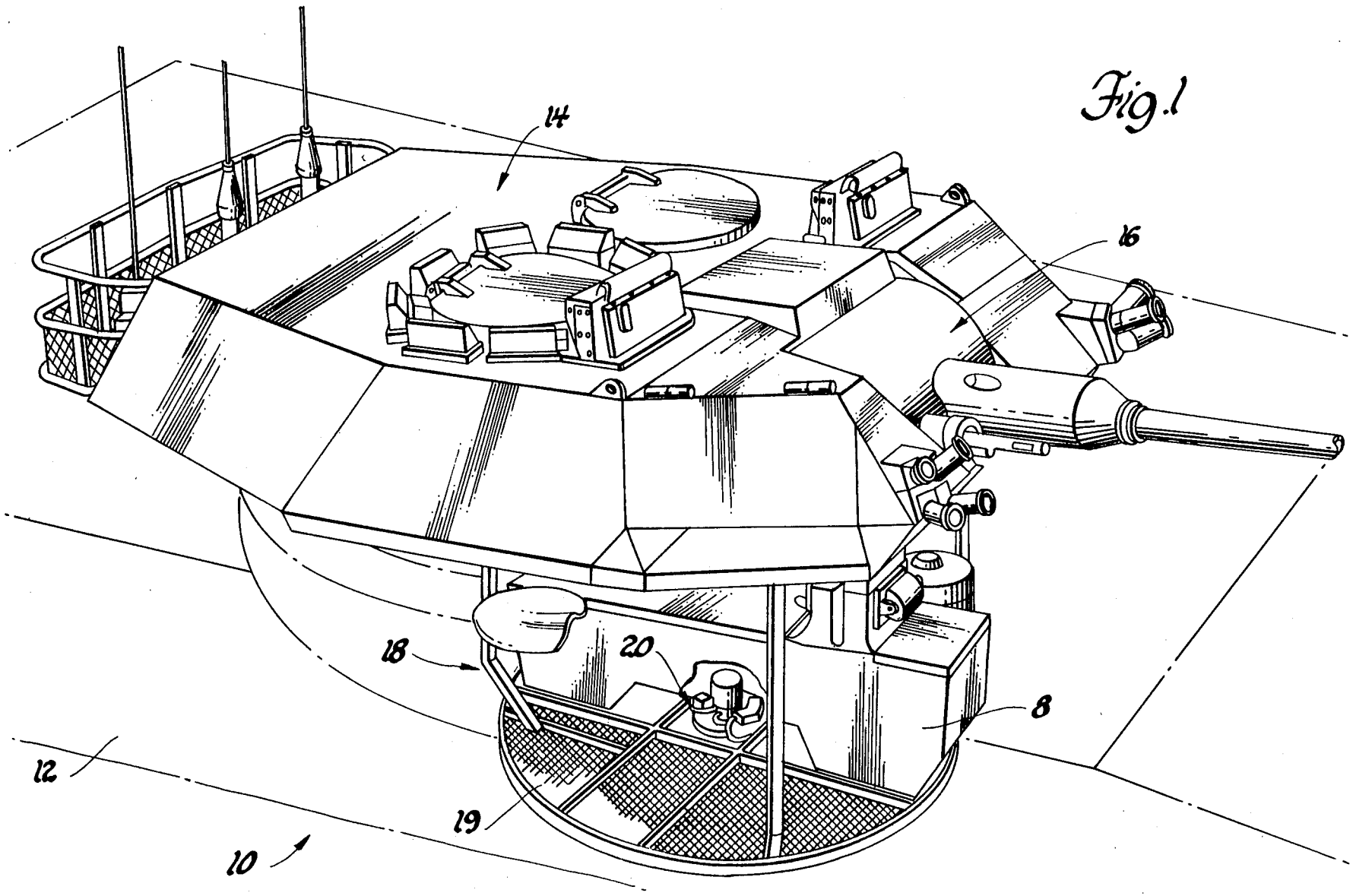
FIG. 1 is a perspective view of the vehicle with a portion cut away to expose the slip ring assembly in the interior of the weapons system with the cage depending therefrom.

In referring to FIG. 1 it can be seen that the vehicle 10 includes a vehicle body 12 with a turret assembly 14 arranged for rotation within the body on a bearing. The turret assembly 14 carries a weapons system 16 which includes a cannon operable to fire on the desired target. Depending from this turret into the vehicle body is a personnel basket or cage 18 for supporting an operator and a commander who operate various equipment within the cage relating to the weapons and other vehicle systems. Since the personnel seating arrangement is fixed to the cage, the personnel when seated will rotate with the turret assembly as the weapons system 16 is moved to the target.

The cage 18 defines a cage floor 19 for supporting various equipment in addition to the personnel seating arrangement. Low profile slip ring assembly 20, the details of which will be explained hereinafter, is secured to the cage floor 19 and provides a power source to much of the equipment. Across the center of the cage floor is an ammunition box 8 generally rectangular in configuration for storing ammunition used in the weapons system. The unique feature of slip ring assembly 20 permits the ammunition box to be configured and located as shown.

An electrical coupler or slip ring assembly 20 is provided to deliver electricity from a stationary source in the vehicle body to the cage even during rotation. This electrical coupler 20 includes a stationary platter 22 which is fixed relative to vehicle body 12 and a rotatable platter 24 which is fixed to the personnel cage 18. Platter 22 (or planar disk) defines a number of concentric electrical conductive grooves 26 which are insulated from one another and can be connected to a stationary electrical source within the vehicle. A power brush 28 is arranged on the rotatable platter 24 (or plate member) for engaging grooves 26 to receive the electrical signal delivered thereto and transmitting this power to various equipment connected to the brushes within the personnel cage. In addition, there are provided two signal brush assemblies 30 which receive and transmit through electrical connectors various signals such as communication signals to and from stationary sources in the vehicle.

Figure 2:
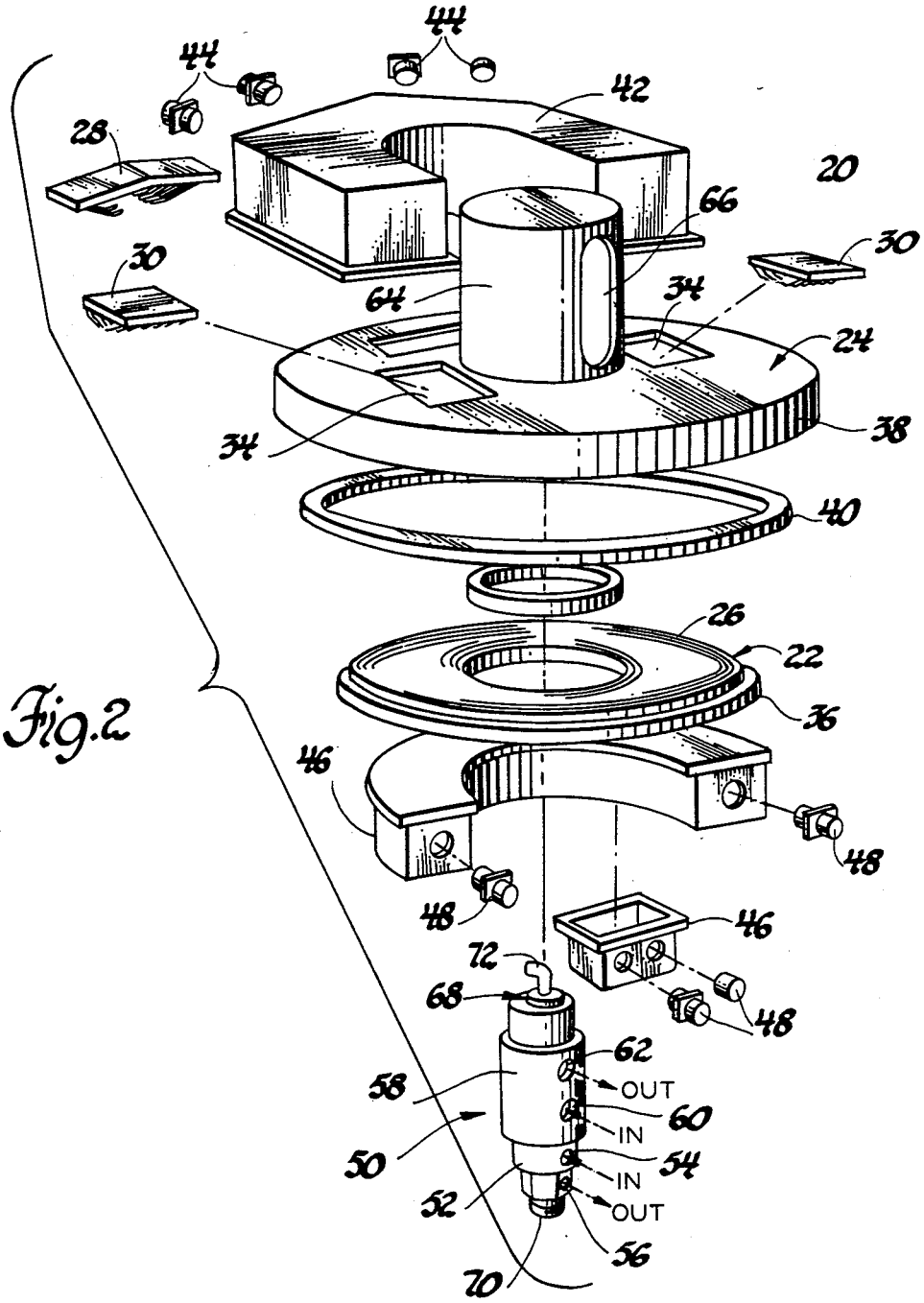
FIG. 2 is an exploded view of the slip ring assembly of the invention.
Figure 3:
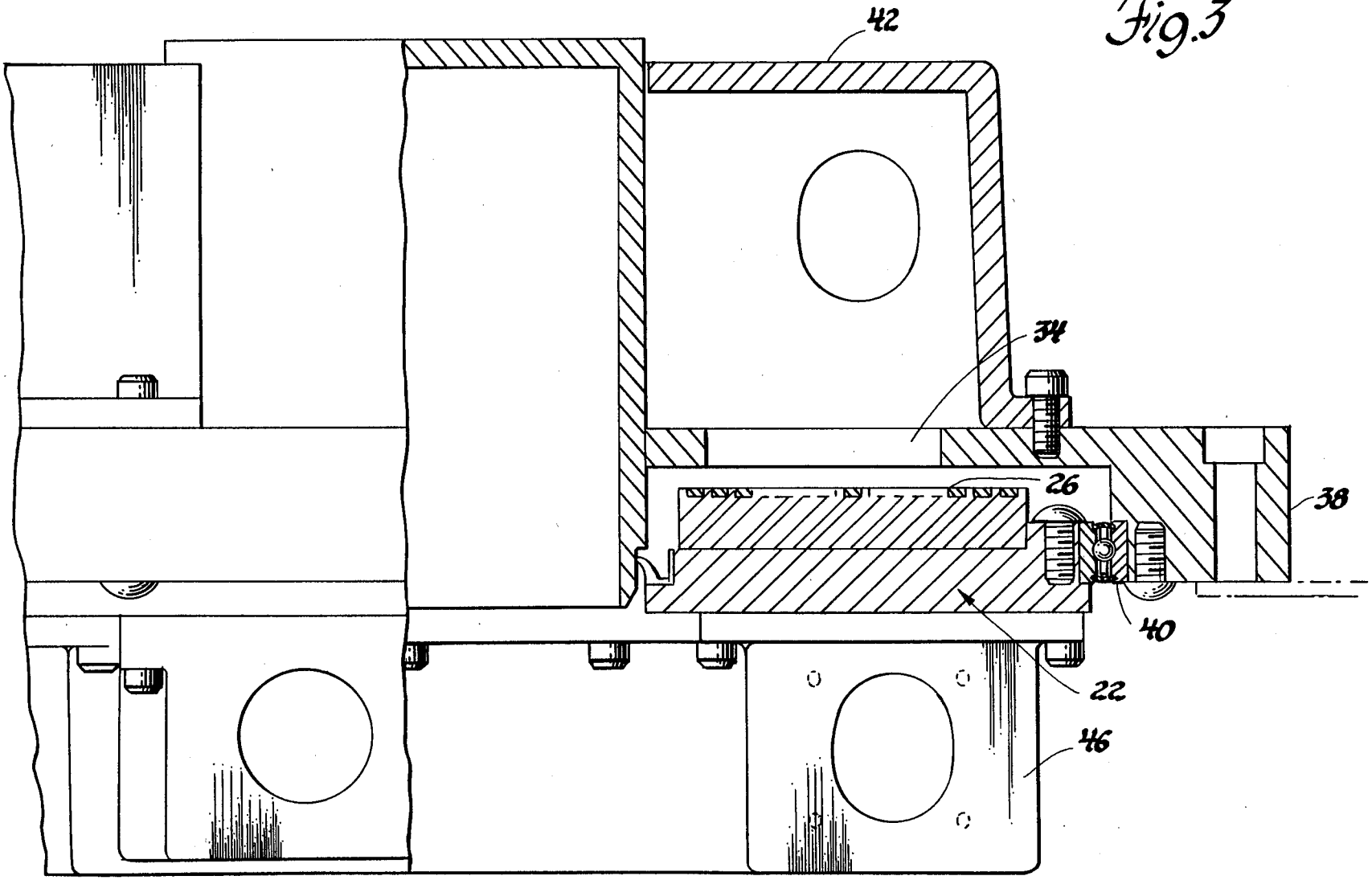
FIG. 3 is a cross-section of a part of the slip ring assembly as fitted together.

The platter-brush assemblies are configured to provide for replacement of the brushes. The rotatable platter 24 for this purpose defines a power brush cavity or opening 32 and a signal brush cavities or openings 34 for receiving respectively the power brush 28 and the signal brushes 30. These brushes are arranged on support assemblies and fixed to the cavities as shown in FIG. 2 in a removable or plug in fashion such that different brush configurations with their respective connector assemblies can be employed for different equipment or electrical systems used within the cage without having to remove the larger parts of the rotatable platter 24.

Both platters 22 and 24 are integrated with a bearing means to control and enhance relative rotation. Stationary platter 22 includes a platter support 36 which is in the form of a ring extending downwardly and perpendicularly from the stationary platter 22 completely circumscribing this platter and which is fixed to the vehicle body 12. The rotatable platter 24 includes a skirt 38 which also extends perpendicularly downwardly from the rotatable platter 24 for telescoping over the platter support 36. Intermediate the platter support 36 and the rotatable platter skirt 38, bearing 40 is fitted to facilitate relative movement between these two elements 36 and 38.

A top cover 42 extends partially over top platter 24 envelopes the power brush 28 and signal brush 30 once the brushes are properly in place in their respective cavities. Cover 42 further defines a number of turret connectors 44 fixed to the cover 42 and exposed for connecting the various equipment within the cage 18 to brushes 28 and 30. The connectors 44 are electrically connected to their respective brushes for transmitting the electrical signal from the brushes as they engage various grooves 26 on stationary platter 22. Similarly, a cable housing 46 is located beneath stationary platter 22 for housing the various cables arranged therein for connecting various grooves of the stationary platter 22 to the stationary electrical source within vehicle body 12. Connectors 48 are fixed to cable housing 46 and exposed for connection to the stationary sources discussed above. Thus, when an electrical source is plugged into a connector, 48 electric current can be transmitted from the source to the grooves 26 in platter 22.

A hydraulic pack 50 is integrated with the assembly noted above to deliver hydraulic medium under pressure to various hydraulically operated equipment with the cage 18. Hydraulic pack 50 includes a stationary fixture 52 having an inlet 54 for high pressure hydraulic liquid and outlet 56 for low-pressure hydraulic fluid. A rotatable sleeve 58 circumscribes the stationary fixture 52 and further includes inlet 60 for receiving low-pressure fluid from the equipment within the cage 18 and an outlet 62 for delivering high-pressure fluid delivered from the stationary fixture 52. Sleeve 58 is fixed to rotatable platter 24 to rotate therewith as the turret assembly 14 is moved by the operators.

The hydraulic pack 50 employed for this embodiment is a Dublin Rotary Union which is a standard item of modular configuration which allows various components to be removed as desired. For example, where the hydraulics or pneumatics are located completely within the turret, the rotary union interface for these items is not required. The modular portion can be removed leaving only an electrical or other power transfer system as required. The configuration of the slip ring is specifically adapted to utilize these features of the Dublin Rotary Union.

A canopy 64 having a cylindrical configuration circumscribes the hydraulic pack and defines an opening 66 to expose the inlet 60 and outlet 62 of rotatable sleeve 58. A pneumatic fixture 68 is provided to accompany a pneumatic power source through the center of hydraulic pack. This pneumatic fixture 66 includes an inlet 70 for receiving pneumatic pressure at the bottom of the hydraulic pack 50 and an outlet 72 having an adaptor thereon to connect the pneumatic pressure to pneumatic equipment within the cage 18.

In operation the power source through electrical leads is plugged into the electrical connectors 48 on a cable housing. Within the housing from the connectors 48 various leads are in turn connected to their corresponding or respective grooves 26 to the slip ring stationary platter 12. Similarly, the brushes on the rotatable platter 24 are fixed in place so that the various brushes engage their respective grooves 26 for picking up the electrical signal delivered to a particular groove and delivering that signal through its respective brush to the various electrical connectors 44 on the top cover 42 fixed to the rotatable platter 24. These electrical connectors 44 are in turn connected to various electrical equipment in the cage 18. In this manner as the cage 18 is rotated as part of the turret assembly 14 the brushes are always engaged with their respective grooves to deliver an electrical signal to the electrical equipment in the cage 18 regardless of its position or movement relative to the stationary vehicle. Similarly, hydraulic fluid under pressure is delivered into the stationary portion and dispensed through the rotatable portion to the various hydraulically operated equipment within the cage 18. Spent fluid on the other hand is returned through rotatable inlet 60 and delivered through the hydraulic pack 50 to an outlet 56 for a return to a reservoir as part of the hydraulic system within the stationary portion of the vehicle. Any pneumatics in the cage are simply delivered directly through the center of the hydraulic pack 50 having a tube outlet 72 for this purpose. The pneumatic system employs a conventional rotatable coupling to receive and deliver air or other gas under pressure and deliver it to equipment within the cage 18 as the cage 18 is rotated.

It should be understood that the above has been a detailed description of a preferred embodiment. The full scope of the invention is defined in the claims which follow including all equivalents and obvious modifications.

I claim:

1. An armored vehicle comprising:

a turret assembly;

a vehicle body;

said turret assembly being supported by and rotatable relative to said vehicle body and including a cage having a cage floor;

an electrical source and a source of pressurized fluid in said vehicle body;

terminals for electrical equipment in said turret assembly;

a slip ring assembly located in the center of said cage floor for electrically connecting said terminals in said turret assembly to said electrical source in said vehicle body;

said slip ring assembly including, a. a planar disk carried by said vehicle body and having concentric electrical conductive grooves insulated from one another, at least some of said grooves being connected to said electrical source;

b. a circular platter member fixed to said turret assembly and rotatable therewith and having a depending skirt circumferentially surrounding the periphery of said planar disk;

c. bearing means between said periphery of said planar disk and said skirt of said platter member for allowing relative rotational movement therebetween;

d. said platter member having a plurality of circumferentially spaced cavities formed therein offset from the center of said platter member and in vertical alignment with said electrical conductive grooves of said planar disk;

e. plug-in type brush means removably located in said cavities of said platter member for engaging said electrical conductive grooves, said brush means being formed of electrically conductive material and connected to said electrical equipment in said turret assembly to conduct electricity from said electrical source to said planar disk and to said electrical equipment as said brush means is rotated about the surface of said planar disk;

f. said planar disk and said platter member each having a centrally located opening formed therein;

g. a coupling located in said centrally located opening in said planar disk and said platter member for delivering pressurized fluid from said source of pressurized fluid to said turret assembly; and h. an ammunition box for holding ammunition employed by said turret assembly and extending diametrically through the center of said cage floor over said slip ring assembly.

2. An armored vehicle comprising:

a turret assembly;

a vehicle body;

said turret assembly being supported by and rotatable relative to said vehicle body;

an electrical source and a hydraulic source in said vehicle body;

hydraulic equipment located within said turret assembly;

terminals for electrical equipment in said turret assembly;

a slip ring assembly for electrically connecting said terminals in said turret assembly to said electrical source in said vehicle body;

said slip ring assembly including;

a. a planar disk carried by said vehicle body and having concentric electrical conductive grooves insulated from one another, at least some of said grooves being connected to said electrical source;

b. a circular platter member fixed to said turret assembly and rotatable therewith and having a depending skirt circumferentially surrounding the periphery of said planar disk;

c. bearing means between said periphery of said planar disk and said skirt of said platter member for allowing relative rotational movement therebetween;

d. said platter member having a plurality of circumferentially spaced cavities formed therein offset from the center of said platter member and in vertical alignment with said electrical conductive grooves of said planar disk;

e. plug-in type brush means removably located in said cavities of said platter member for engaging said electrical conductive grooves, said brush means being formed of electrically conductive material and connected to said electrical equipment in said turret assembly to conduct electricity from said electrical source to said planar disk and to said electrical equipment as said brush means is rotated about the surface of said planar disk;

f. said planar disk and said platter member each having a centrally located opening formed therein; and g. a hydraulic coupling located in said centrally located opening in said planar disk and said platter member for delivering hydraulic fluid from said hydraulic source to said hydraulic equipment located within said turret assembly.

* * * * *